United States Patent [19]

Schlund et al.

[11] Patent Number: 4,632,319

[45] Date of Patent: Dec. 30, 1986

[54] CABLE CONNECTOR INTERLOCK ARRANGEMENT FOR ELECTRIC SHREDDERS

[75] Inventors: Gerald Schlund, Wiesbaden; Leonhard Hagedorn, Niederneisen, both of Fed. Rep. of Germany; A. David Hahn, Arnold, Md.; Charles E. Fishpaugh, Madison, Conn.

[73] Assignee: Black & Decker Inc., Newark, Del.

[21] Appl. No.: 764,905

[22] Filed: Aug. 12, 1985

[51] Int. Cl.[4] ..... B02C 18/12; B02C 25/00

[52] U.S. Cl. ..... 241/37.5; 241/92

[58] Field of Search ..... 339/75 M, 147, 75 R; 241/36, 37.5, 282.1, 282.2, 92, 285 R, 285 A, 285 B, 101.7

[56] References Cited

U.S. PATENT DOCUMENTS

| | | | |
|---|---|---|---|
| 2,894,551 | 7/1959 | Otto | 241/37.5 |
| 2,899,140 | 8/1959 | Hellyer | 241/190 |
| 2,934,116 | 4/1960 | Dannenmann | 241/37.5 |
| 4,360,166 | 11/1982 | Biersack | 241/92 |

FOREIGN PATENT DOCUMENTS

| | | | |
|---|---|---|---|
| 3325766 | 1/1985 | Fed. Rep. of Germany | 241/37.5 |
| 2447703 | 10/1980 | France | 241/37.5 |
| 2098504 | 10/1984 | United Kingdom . | |

*Primary Examiner*—Mark Rosenbaum

*Attorney, Agent, or Firm*—Edward D. C. Bartlett; Edward D. Murphy; Charles E. Yocum

[57] ABSTRACT

An electric device, for example a shredder, comprises a cutter mounted on a base and driven by an electric motor, the cutter being concealed by a removable feed chute. A plug connector of a cord set is movably secured to the feed chute, and is moved towards and away from the feed chute to plug it with and unplug it from a plug connector of the motor. The plugging together of the plug connectors prevents removal of the feed chute; it being necessary to unplug the connectors to disconnect electrical supply to the motor by moving the cord set plug connector outwardly of the base before the feed chute can be removed to expose the cutter. Preferably, the cord set has incompatible plug connectors at each end to prevent a normal extension cord being plugged to said motor plug connector when said feed chute is removed.

20 Claims, 8 Drawing Figures

CABLE CONNECTOR INTERLOCK ARRANGEMENT FOR ELECTRIC SHREDDERS

FIELD OF THE INVENTION

This invention relates to safety arrangements for electric devices having cutting, shredding or the like members, particularly electric garden shredders.

BACKGROUND OF THE INVENTION

Electric shredders and similar electrical appliances for shredding, cutting or disintegrating material fed to rotating operating members are known. For example, U.S. Pat. No. 4,360,166 discloses an electric garden shredder having a removable feed chute through which garden trash is fed to a shredding rotor.

For cleaning or other purposes the feed chute or other container may be removable so exposing the cutting or shredding members. As a safety precaution it is desirable to interrupt power to the electric motor driving the cutting member when the feed chute is removed.

United Kingdom Pat. No. 2,098,504 B discloses an electric garden shredder in which removal of the feed chute automatically opens a switch to disconnect power to the electric motor. However, with the feed chute removed, power can be restored to the motor by manually depressing this safety switch.

Also, U.S. Pat. No. 2,899,140 discloses an ice crusher in which removal of the crushed ice container triggers a safety switch to disconnect the electric motor. However, again, after the container is removed and the hammer crushing rotor is somewhat exposed, the safety switch is capable of manual actuation to energize the motor and operate the crushing rotor.

SUMMARY OF THE INVENTION

It is the object of the present invention to provide a safety arrangement for electric shredders and the like whereby the cord by which electrical power is supplied to the device must be disconnected from the electric motor before a feed chute or other container is removed to expose an operating member.

A feature by which this is achieved in a preferred embodiment of the invention is by attaching the supply cord to the devices by means of a "lost-motion" mechanical connection, and arranging a connector of the supply cord to prevent removal of the feed chute or other container while the supply cord is electrically plugged to the device.

In a further preferred feature, the connector of the supply cord is mechanically coupled to the removable feed chute or other container so that the supply cord is totally removed therewith. This has the advantage that once the removable container is removed to expose the operating member, the motor cannot be energized.

A further preferred feature provides a supply cord with incompatibly configured or dimensioned connectors at both ends so that a normal extension cord cannot be plugged directly to the device. This has the advantage that the motor can then only be readily energized via the supply cord attached to the removable container, this only being possible when the removable container is in position concealing the cutting or other operating member.

Accordingly, therefore, there is provided by the present invention an electric device having an electric motor drivingly connected to an operating member, for example a rotatable cutting or shredding assembly. A removable container, for example a feed chute, is associated with the operating member, to normally shield the latter, but the operating member is exposed when the container is removed. Motor socket means provides for connection of electrical power to the motor, and is preferably mounted on the motor. Cable socket means, preferably connected to one end of a cord set, plugs to the motor socket means for supplying electrical power thereto. Coupling means, for example a lost-motion linkage, may mechanically couple the cable socket means to the device, preferably to the removable container thereof, and allow relative motion between the two socket means when the container is in position shielding the operating member. Stop means prevents removal of the container from the device when the two socket means are plugged together, and allows such removal when the two socket means are relatively moved apart to unplug them.

The cable socket means may be movably mounted on a bracket attached to the removable container, and may engage under a base frame portion of the device when plugged to the motor socket means but clear this base frame portion when unplugged.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
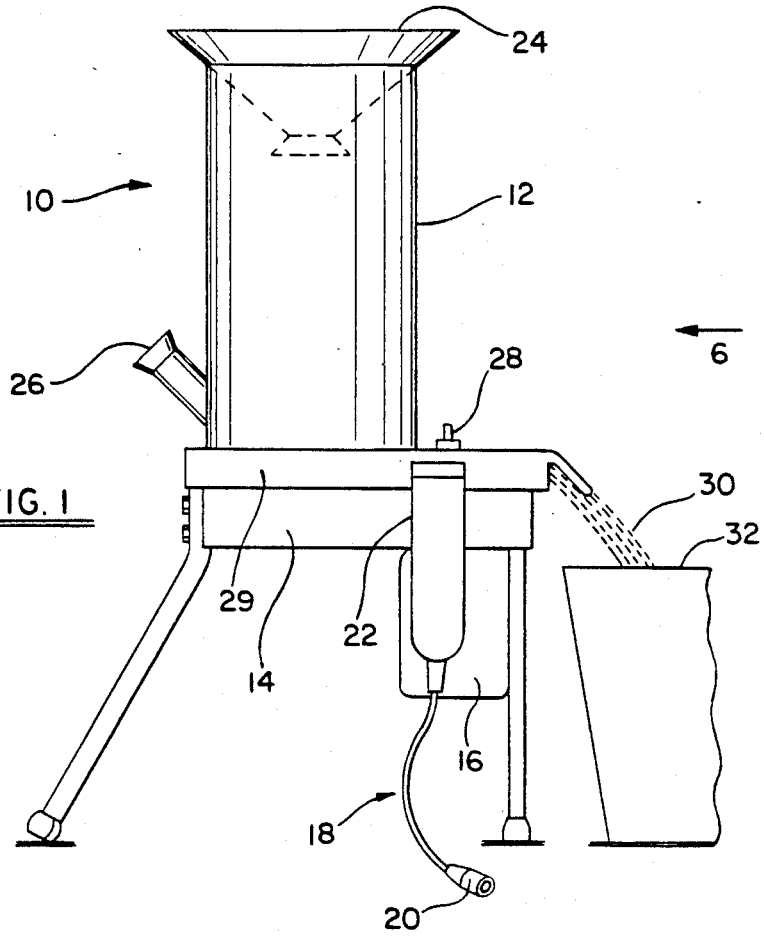
FIG. 1 is a side elevational view diagrammatically illustrating an electric garden shredder to which the present invention has been applied.
Figure 2:
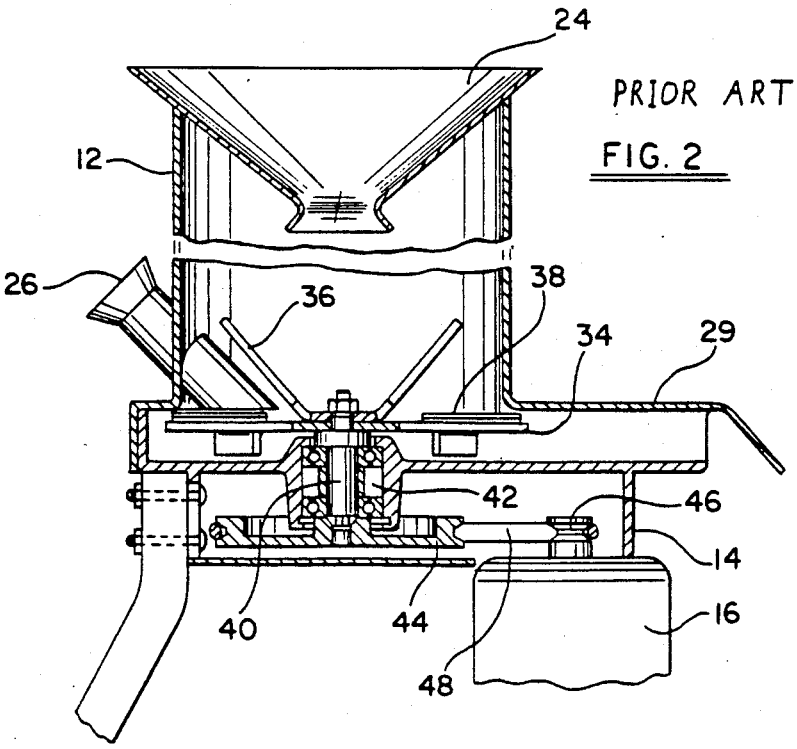
PRIOR ART FIG. 2
FIG. 2 is a simplified diagrammatic vertical section of part of the electric shredder of FIG. 1 and illustrates the shredding mechanism.

FIGS. 1 and 2 show an electric garden shredder to which the safety arrangement of the present invention has been applied, the preferred embodiment of this safety arrangement being shown in greater detail in FIGS. 3 through 8.

FIG. 1 shows the electric garden shredder 10 having an upper vertical cylindrical feed chute 12 mounted on and attached to a three legged base 14. An electric motor 16 for driving the mechanism of the shredder is mounted under the upper part of the base 14. A cord set 18 for connecting the motor 16 to a source of electrical supply has a lower end connector 20, for connection to an outside extension cable, and an upper end connector 22 attached to the shredder 10. The feed chute 12 has an upper main inlet 24 and a smaller auxiliary inlet 26 to one side. A thumb screw 28 tightly secures a flanged base 29 of the feed chute 12 to the base 14. In use, garden trash is fed into the feed chute 12 through either of the inlets 24, 26 and the shredded trash 30 is discharged into a container 32.

FIG. 2 illustrates the shredding mechanism of the shredder 10, and shows a rotor 34 having upwardly inclined cutting blades 36 and surface cutting blades 38, the rotor 34 being mounted on a short shaft 40 journaled in a bearing 42. A pulley 44 on the lower end of the shaft 40 is driven by a pulley 46 of the motor 16 via an endless belt 48. The motor 16 is mounted for adjustable movement sideways relative to the base 14 for adjusting the tension of the belt 48. For further details of this cutting and shredding mechanism and the operation thereof to shred garden trash, reference is made to U.S. Pat. No. 4,360,166 the disclosure of which is hereby incorporated herein by reference.

Figure 3:
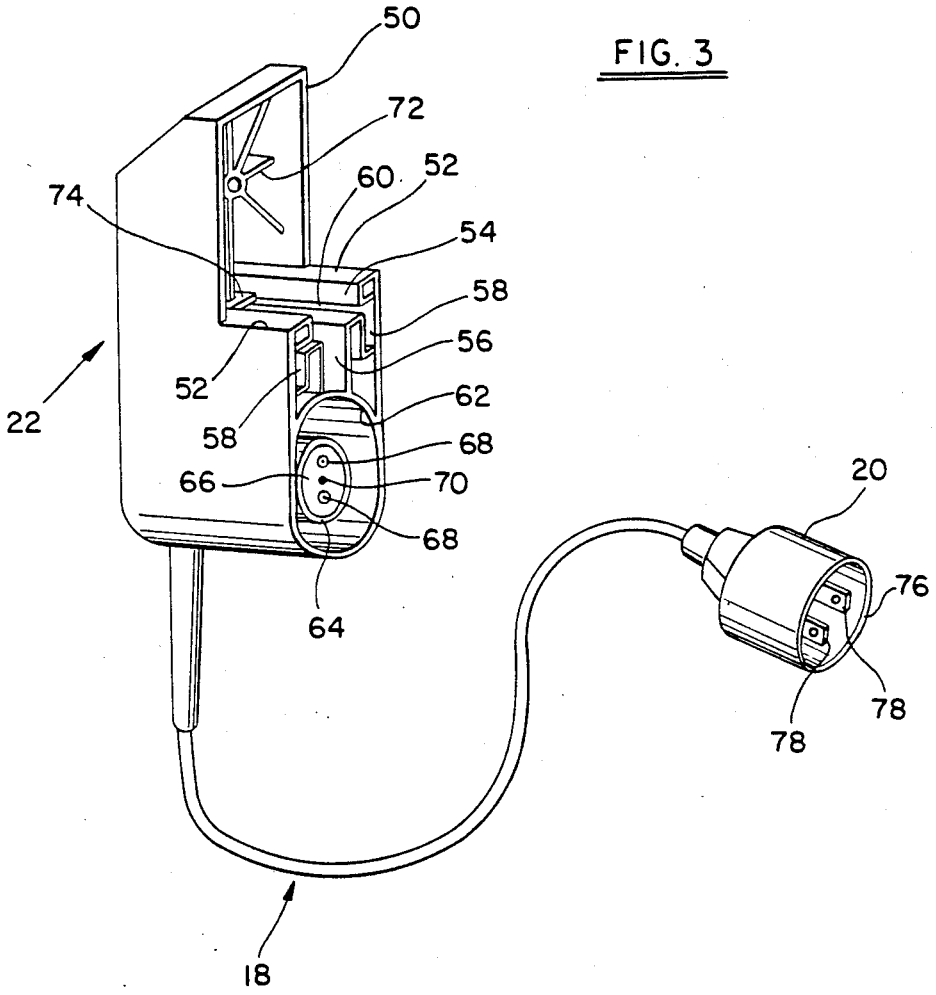
FIG. 3 is a perspective view of a cord set according to the present invention and shown removed from the electric shredder of FIG. 1.

FIG. 3 shows in greater detail the cord set 18. The upper end connector 22 is formed with a large shroud-like housing 50 of electrically insulating plastic material. In side view, the housing 50 has a narrower top portion and a wider lower portion with a step 52 on each side therebetween. Each side step 52 is formed with an inwardly projecting lip 54 of box-like cross section which extends from the front to the back of the housing 50. Below each lip 54 is a partition structure 56 which defines a channel 58 below the respective lip 54 with a gap 60 between the top of the partition structure 56 and the underside of the respective lip 54. The lower portion of the housing 50 has two concentric cylindrical partitions 62, 64 formed integrally therewith, the larger cylindrical partition 62 being connected to lower wall portions of the partition structures 56. The smaller inner cylindrical partition 64 is recessed below the outer edge of the cylindrical partition 62 and contains a female electrical socket 66. The female socket 66 is secured by a screw 70 and has two bores 68 for receiving electrical plug prongs. The upper portion of the housing 50 has a series of radially extending reinforcing webs 72 recessed below the front edge thereof, i.e. the right hand edge in FIG. 3. Transverse webs 74 extend between the lips 54 and the partition structures 56, and support sockets for securing a retaining metal plate between the partition structures 56 as will be described in greater detail later. The lower end connector 20 has a cylindrical wall socket 76 containing two rectangular cross sectioned plug prongs 78. It should be particularly noted that the plug prongs 78, apart from being of different cross sectional shape to the bores 68 of the female socket 66, will not plug into the bores 68 as the bores 68 are smaller. The size and configuration of the plug prongs 78 are determined by the type of electrical supply available and to be used with the shredder; whatever the shape and size of the prongs 78 are, the shape and size of the bores 68 are chosen to be incompatible so that the available electrical supply could not be connected to the female socket 66, as will be more fully understood later.

Figure 4:
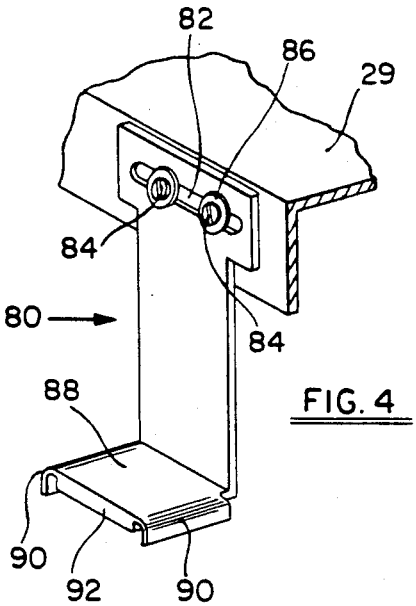
FIG. 4 is a fragmentary perspective view showing a bracket according to the invention for attaching the cord set of FIG. 3 to the upper part of the electric shredder in FIG. 1.

FIG. 4 is a perspective view of a metal bracket 80 attached to a side flange of the base 29 of the feed chute 12. In FIG. 1 the bracket 80 is concealed by the upper end connector 22 inside which it is also attached. The upper end of the bracket 80 has a transverse slot 82 through which two screws 84 extend and secure the bracket to the flange of the base 29. Washers 86 are disposed between the heads of the screws 84 and the bracket 80, the slot 81 enabling the bracket to be moved a limited amount relative to the flanged base 29 for alignment purposes. In end view the bracket 80 is L-shaped and has a base leg or step 88 which extends outwardly away from the flanged base 29. On either side of the leg 88 is a downwardly turned side flange 90. At the outer extremity of the leg 88, between the side flanges 90, is a shorter downwardly turned front flange 92 which functions as a stop, as will be described later.

Figure 5:
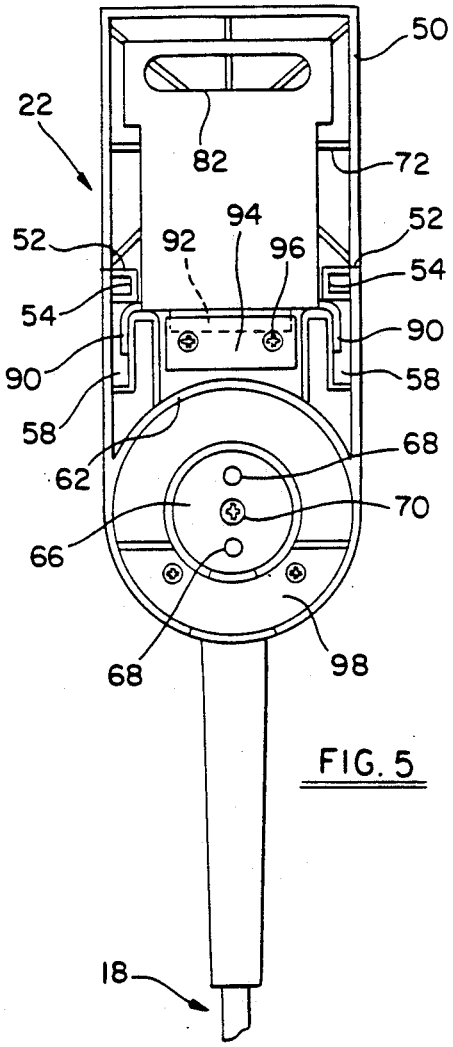
FIG. 5 is an elevational view looking into the upper end connector of the cord set of FIG. 3 and showing the bracket of FIG. 4 engaged therein.

FIG. 5 shows a view looking into the upper connector 22, i.e. from the right hand side in FIG. 3, with the L-shaped bracket 80 assembled therein. For clarity, the bracket 80 is not shown connected to the flanged base 29. The bracket 80 fits inside the side walls of the housing 50 and between the inwardly turned lips 54 with the downward side flanges 90 slidably engaging in the channels 58. After the bracket and the upper connector 22 have been so assembled, a metal retaining plate 94 is secured by two screws 96 to the housing 50 to cover the transverse flange 92 of the bracket 80 and so retain the bracket in the housing 50. The side flanges 90 are capable of limited sliding movement backwards and forwards in the channels 58 with the transverse flange 92 engaging the retaining plate 94 to limit movement of the plate 80 out of the housing 50. FIG. 5 also shows a front view of the female socket 66 with the electrical connection bores 68, and a member 98 physically anchoring the cord of the cord set 18 inside the cylindrical partition 62.

Figure 6:
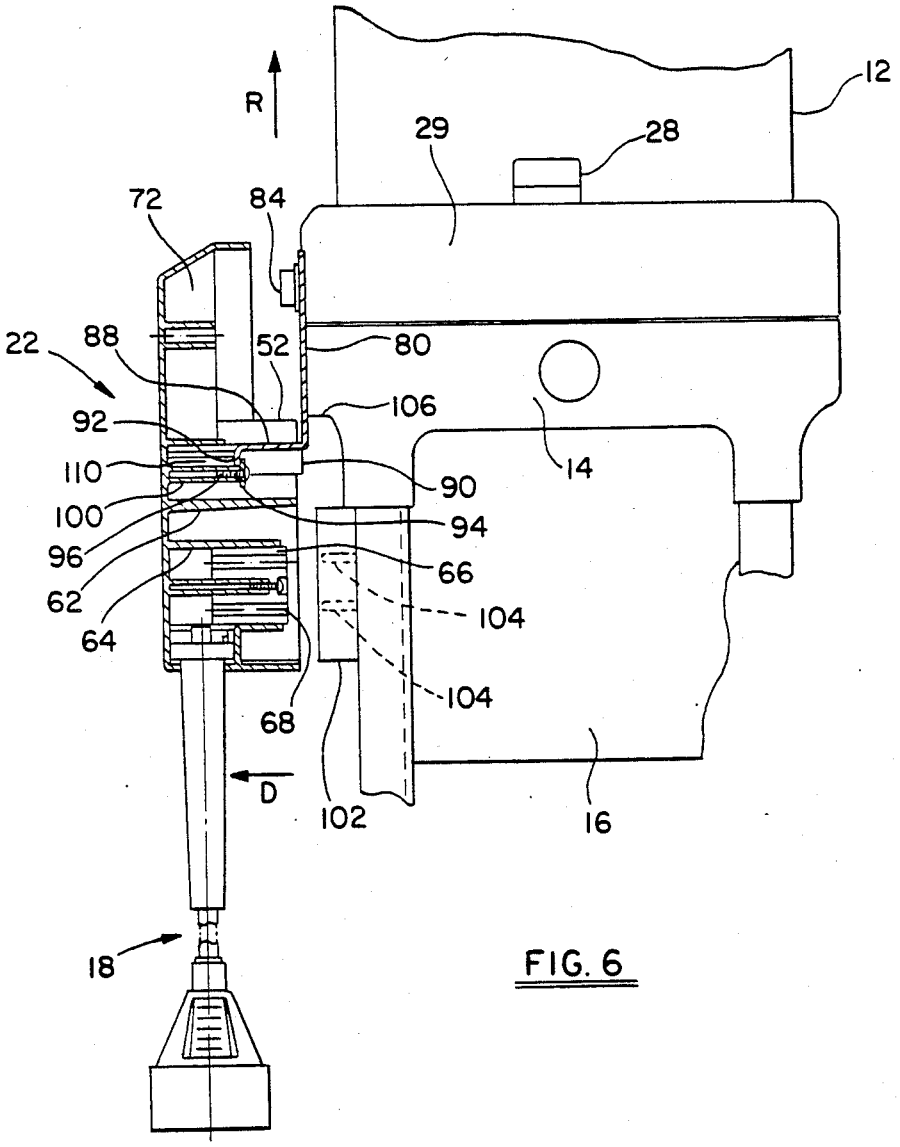
FIG. 6 is a front view of a portion of the electric shredder according to the invention in the direction of the arrow 6 in FIG. 1 with the upper connector of the cord set and the bracket of FIG. 4 shown in section, and with the upper end of the cord set in a position in which it is electrically disconnected from the electric motor of the electric shredder.

FIG. 6 is a view in the direction of the arrow 6 in FIG. 1 and shows the bracket 80 and upper cord set connector 22, both in section, inter-connected and the bracket 80 connected by screws 84 to the flanged base 29 of the feed chute 12. A cylindrical connection socket 102 extends from the side of the electric motor 16 and contains two cylindrical plug prongs 104. The plug prongs 104 align with the bores 68 of the female socket 66, but are shown in FIG. 6 disengaged therefrom with the upper cord set connector 22 moved in the direction of the arrow D to its maximum distance away from the shredder's base 14 and the socket 102. In this position the feed cylinder 12 can be removed from the base 14 by unscrewing the thumb screw 28 and then lifting upwardly, the cord set connector 22 being able to move upwardly therewith clearing the motor socket 102 and the side of the base 14. In the position shown in FIG. 6, the connector 22 is prevented from moving to the left further and being disconnected from the bracket 80 by the retaining plate 94 of the connector 22 engaging the flange 92 of the bracket 80. One of the screws 96 securing the retaining plate 94 in position can be seen threadedly engaged in a socket 100 extending from the back wall of the connector 22. The connector 22 can be moved towards the base 14 and motor socket 102 with the bracket side flanges 90 sliding in the channels 58 (see also FIGS. 3, 4 and 5) and the transverse flange 92, together with the lower leg 88 of the bracket 80, sliding inwardly into and along a cavity 110 inside the connector 22. Such movement is not hindered by the base 14 due to the narrower top portion of the connector 22, and the step 52 at the bottom thereof being at a slightly lower lever than the bottom outside edge 106 of the base 14, i.e. the step 52 can pass under the lower edge 106 of the base 14. During such inward movement of the connector 22, the cylindrical partition 62 passes over the outside of the cylindrical motor socket 102, and the female socket 66 enters inside the motor socket 102 so that the plug prongs 104 enter into the bores 68 and make electrical connection between the cord set 18 and the motor 16. As can be seen, the inner surface of the cylindrical partition 62 and the outer surface of the motor socket 102 are both slightly tapered to ensure a tight fit therebetween as the cylindrical partition 62 is pressed over and onto the motor socket 102.

Figure 7:
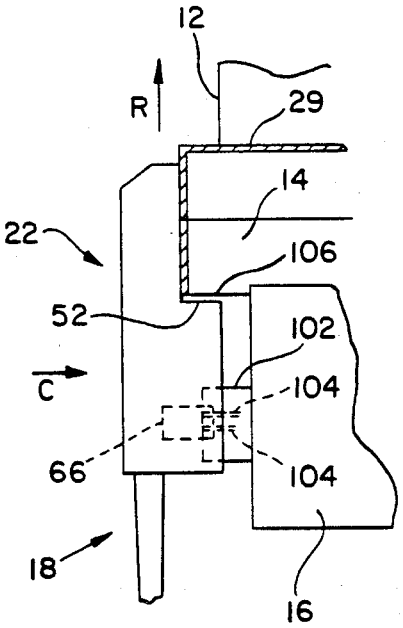
FIG. 7 is a diagrammatic fragmentary view of part of FIG. 6, with parts omitted for clarity and the upper connector of the cord set not shown in section, and with the upper end of the cord set plugged to the electric motor and in electrical connection therewith.

FIG. 7 illustrates the cord set connector 22 in electrical connection with the motor socket 102 after the connector 22 has been moved in the direction of the arrow C fully towards the flanged base 29 and the motor socket 102. The step 52 between the upper and lower portions of the connector 22 has passed below the lower edge 106 of the base frame 14, and in broken lines the motor socket plug prongs 104 can be seen engaged in the female socket 66 of the connector. In this position electrical connection between the cord set 18 and the motor 16 is established, and the feed cylinder 12 cannot be lifted off the base frame 14 even if the thumb screw 28 (see FIGS. 1 and 6) is unscrewed. This is firstly because of the engagement of the plug prongs 104 in the female socket 66, secondly because of the engagement of the outer cylindrical partition of the connector 22 over the motor socket 102, and thirdly because of the engagement of the step 52 of the connector 22 underneath the lower edge 106 of the base frame 14. Thus, the cutting rotor 34 cannot be exposed while there is electrical connection between the cord set 18 and the motor 16.

Figure 8:
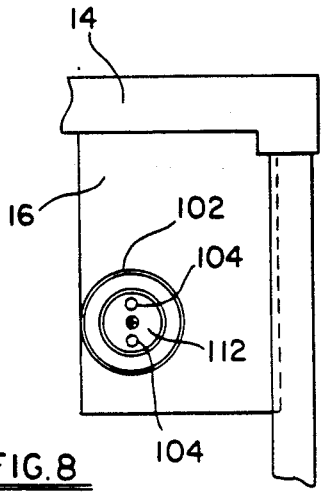
FIG. 8 is a diagrammatic view in the direction of FIG. 1 illustrating a male electrical connection socket on the electric motor.

FIG. 8 is a fragmentary view in the direction of the arrow C in FIG. 7 but with the cord set connector 22 and the bracket 80 omitted to clearly show the motor socket 102. Spaced concentrically inwardly of the peripheral wall of the motor socket 102, and recessed well below the outwardly extending end thereof, is secured a plug base 112 carrying the two outwardly extending plug prongs 104. These motor plug prongs 104 are differently configured and shaped to the plug prongs 78 of the lower end connector 20 of the cord set, so that the female end of any electrical extension cord to which the lower end cord set connector 20 could be plugged, will not plug to the motor plug prongs 104. This provides the safeguard that when the feed chute 12 together with the cord set connector 22 have been removed from the shredder, the available electrical extension cord cannot be plugged directly into the motor socket 102; this further prevents energisation of the motor 16 when the cutting blades 36, 38 are exposed.

It will be appreciated, therefore, that by attaching the cord set connector 22 to the feed chute 12 with a type of lost-motion connection therebetween, both physical and electrical connection between the cord set connector 22 and the motor 16 have to be broken before the feed chute 12 can be removed to expose the cutting blades. Further, electrical connection between the cord set connector 22 and the motor 16 cannot be re-established until the feed chute 12 is correctly positioned. It should be further noted that even should feed chute retaining screw 28 become loosened, the feed chute would still be retained in position on the base frame 14 by the cord set connector 22 and the bracket 18 as long as there was electrical connection between the cord set connector 22 and the motor 16.

Although the preferred embodiment of the present invention has been described above in relation to a garden shredder, it will be appreciated that it could be applied to other electrical devices having a feed chute or container covering one or more movable cutting blades. For example, the present invention could be employed with a food processor and other kitchen appliances having rotating cutting, shredding or beating members.

The above described embodiments, of course, are not to be construed as limiting the breadth of the present invention. Modifications, and other alternative constructions, will be apparent which are within the spirit and scope of the invention as defined in the appended claims.

What is claimed is:

1. An electric device, comprising:

an electric motor drivingly connected to an operating member;

a removable container associated with and shielding said operating member, said operating member being exposed when said container is removed from the electric device;

motor socket means for connection of electrical power to said motor;

cable socket means for plugging to said motor socket means for supplying electrical power thereto;

stop means for preventing removal of said container from said device when said cable socket means and said motor socket means are plugged together, and for allowing removal of said container when said cable socket means and said motor socket means are moved relative to each other to become unplugged;

coupling means for mechanically coupling said cable socket means to said container, and for allowing relative movement between said cable socket means and said motor socket means when said container is in position shielding said operating member to enable said cable socket means and said motor socket means to be plugged together and unplugged; and said coupling means comprising a member secured to said container and connected via a lost-motion connection to said cable socket means.

2. The electric device of claim 1, wherein said member comprises a bracket having an extending leg which is slidably engaged in said cable socket means.

3. The electric device of claim 2, wherein said leg has side flanges which slidably engage in channels in said cable socket means, and said leg has a flange between said side flanges which engages a securing plate of said cable socket means to limit separating movement of said bracket relative to said cable socket means.

4. The electric device of claim 6, wherein said stop means comprises interengaging male and female plug connectors of said cable socket means and said motor socket means, said container being removable from said device in one direction and said plug connectors being plugged and unplugged in another direction at right angles to said one direction.

5. The electric device of claim 4, wherein said stop means further comprises a cylindrical partition in said cable socket means around the plug connector thereof and a cylindrical socket wall around the plug connector of said motor socket means, said cylindrical partition engaging over said cylindrical socket wall when said plug connectors are plugged together.

6. The electric device of claim 5, wherein inner and outer surfaces of said cylindrical partition and said cylindrical socket wall, respectively, are correspondingly tapered and engage each other when said plug connectors are plugged together.

7. An electric device, comprising:

an electric motor drivingly connected to an operating member;

a removable container associated with and shielding said operating member, said operating member being exposed when said container is removed from the electric device;

motor socket means for connection of electrical power to said motor;

cable socket means for plugging in said motor socket means for supplying electrical power thereto;

stop means for preventing removal of said container from said device when said cable socket means and said motor socket means are plugged together, and for allowing removal of said container when said cable socket means and said motor socket means are moved relative to each other to become unplugged; and said stop means comprising a step in said cable socket means and a side portion of a base frame member of said device, said step engaging under said side portion when said cable socket means and said motor socket means are plugged together.

8. The electric device of claim 7, further comprising coupling means for mechanically coupling said cable socket means to said container, and for allowing relative movement between said cable socket means and said motor socket means when said container is in position shielding said operating member to enable said cable socket means and said motor socket means to be plugged together and unplugged.

9. The electric device of claim 7, wherein said operating member comprises a rotatable cutter, and said container comprises a feed chute.

10. The electric device of claim 7, wherein said motor socket means comprises an electrical socket on said motor.

11. The electric device of claim 10, wherein said cable socket means comprises an electrical connector at one end of a cord set, and another end of said cord set has an electrical connector which is incompatible with said connector at said one end.

12. An electric garden shredder, comprising:

a base frame supported on legs;

a cutting rotor rotatably mounted in said base frame;

an electric motor supported by said base frame and drivingly connected to said cutting rotor, said motor extending downwardly from said base frame;

an electrical socket extending horizontally outwardly from said motor and containing a motor plug connector;

a feed chute supported on said base frame and having a flanged base releasably secured by a fastener to said base frame;

a bracket secured to said flanged base and having a leg portion extending outwardly therefrom parallel to said socket;

a cord set having first and second plug connectors of incompatible configuration which cannot be plugged together;

said first plug connector being contained in a shroud-like housing having a cylindrical partition surrounding said first plug connector;

said leg portion slidably engaging in said housing, and said leg portion of said housing having engaging stop elements to limit relative movement between said housing and said leg portion and prevent withdrawal of said housing from said leg portion, said relative movement being parallel to said socket;

said first plug connector being plugged to and unplugged from said motor plug connector, and said cylindrical partition being engageable with and disengageable from said socket, when said housing is moved along said leg portion respectively towards and away from said socket; and removal of said feed chute upwardly from said base frame being prevented by the plugging together of said first plug connector and said motor plug connector, but being permitted when said housing is withdrawn outwardly along said leg portion to unplug said first plug connector from said motor plug connector and to disengage said partition from said socket.

13. An electric device, comprising:

a base;

a rotatable shredder mounted on said base;

an electric motor supported by said base and drivingly connected to said shredder;

a socket mounted on said motor and containing a motor plug connector;

a feed chute removably mounted on said base and, when in position, concealing said shredder;

a bracket secured to said feed chute;

a cord set having opposite ends each having a plug connector, one of the cord set plug connectors being contained in a shroud-like housing and being plugged to said motor plug connector for supplying electrical power to said motor;

said bracket being connected to said housing to allow limited movement therebetween to enable said one cord set plug connector and said motor plug connector to be plugged together and unplugged; and said feed chute only being removable from said base when said one cord set plug connector is unplugged from said motor plug connector.

14. The electric device of claim 13, further comprising securing means for releasably securing said feed chute to said base independently of said one cord set plug connector and said motor plug connector.

15. The electric device of claim 13, wherein said bracket has a portion slidably engaged in said housing and forming part of a lost-motion linkage between said bracket and said housing.

16. The electric device of claim 15, wherein said housing is slidable relative to said bracket portion in a direction perpendicular to a direction in which said feed chute is removable from said base.

17. The device of claim 13, wherein said bracket is L-shaped, a bottom leg of which has a flange which engages a retaining plate secured to said housing to limit separating relative movement of said housing and said bracket.

18. The device of claim 13, wherein said housing includes a cylindrical partition which engages over said socket when said one cord set plug connector and said motor plug connector are plugged together.

19. An electric device, comprising:

an electric motor drivingly connected to an operating member;

a base supporting said motor and said operating member;

a container removably connected to said base and shielding said operating member, said operating member being exposed when said container is removed from said base;

a motor electrical socket supported by said base and electrically connected to said motor, said motor socket being accessible from exterior of said base;

a cable socket for plugging to said motor socket for connecting external electrical power thereto, said cable socket forming one end of a cord set and said cable socket being moved towards said base from exterior thereof to effect said plugging;

said container including means, cooperative with said cable socket, for effecting interlocking of said container and said base together to prevent removal of said container from said base when said cable socket is plugged to said motor socket; and said means also allowing relative movement between said cable socket and said container and between said cable socket and said base for enabling said cable socket to be unplugged from said motor socket and withdrawn outwardly with respect to both said container and said base to disconnect said interlocking and allow said container to be removed from said base.

20. The electric device of claim 19, wherein:

said operating member comprises a rotatable cutting blade;

said base includes downwardly extending legs for supporting the electric device;

said container comprises a feed chute; and said means comprises a member extending downwardly on the outside of said container at the bottom thereof.

* * * * *